US010330409B2

(12) United States Patent
Bray

(10) Patent No.: US 10,330,409 B2
(45) Date of Patent: Jun. 25, 2019

(54) WORM DRIVE GAS REGULATOR

(71) Applicant: NG2 Defense, LLC, American Fork, UT (US)

(72) Inventor: Ernest R. Bray, American Fork, UT (US)

(73) Assignee: Ernest R. Bray, American Fork, UT (US)

( * ) Notice: Subject to any disclaimer, the term of this patent is extended or adjusted under 35 U.S.C. 154(b) by 0 days.

(21) Appl. No.: 15/873,883

(22) Filed: Jan. 17, 2018

(65) Prior Publication Data

US 2018/0202733 A1 Jul. 19, 2018

Related U.S. Application Data

(60) Provisional application No. 62/447,398, filed on Jan. 17, 2017.

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/20; F41A 5/22; F41A 5/24; F41A 5/26; F41A 5/28; F41A 5/30
USPC ..... 89/191.01, 191.02, 192, 193
See application file for complete search history.

(56) References Cited

U.S. PATENT DOCUMENTS

| | | | | |
|---|---|---|---|---|
| 6,374,720 | B1 * | 4/2002 | Tedde | F41A 1/06 42/78 |
| 8,960,069 | B1 * | 2/2015 | Soong | F41A 5/28 89/193 |
| 9,335,106 | B1 * | 5/2016 | Simon | F41A 5/28 |
| 2010/0275770 | A1 * | 11/2010 | Noveske | F41A 5/28 89/193 |
| 2011/0271827 | A1 * | 11/2011 | Larson | F41A 5/28 89/193 |
| 2014/0076149 | A1 * | 3/2014 | Adams | F41A 5/28 89/192 |
| 2014/0083286 | A1 * | 3/2014 | Gomez | F41A 5/28 89/193 |
| 2015/0292825 | A1 * | 10/2015 | Cassels | F41A 5/28 89/193 |

* cited by examiner

*Primary Examiner* — Bret Hayes
(74) *Attorney, Agent, or Firm* — Kunzler Bean & Adamson

(57) ABSTRACT

A device and system for metering the flow of gas into a gas driven reloading system of a firearm, the device is a gas plate that includes a plurality of openings of differing radii, a plurality of positioning notches formed on an edge of the gas plate, and a series of teeth formed on a surface of the gas plate, where the series of teeth are formed with a pitch configured to correspond with threads of a worm drive, and where at least a partial rotation of the worm drive slidingly positions the gas plate with respect to the adjustable gas regulator. The system includes the device and the adjustable gas regulator having a body configured to receive the device and the worm drive.

16 Claims, 9 Drawing Sheets

WORM DRIVE GAS REGULATOR

CROSS-REFERENCES TO RELATED APPLICATIONS

This application claims the benefit of U.S. Provisional Patent Application No. 62/447,398 entitled "ULTRA-PRECISION WORM DRIVE GAS REGULATOR" and filed on Jan. 17, 2017 for Ernest Bray, which is incorporated herein by reference.

FIELD

This application relates generally to gas regulators for firearms that utilize a gas flow to chamber a new round and rearm a firing mechanism, and in particular, the application relates to an adjustable gas flow volume control device.

BACKGROUND

Many semi-automatic and automatic rifles utilize a gas-driven reloading system. These systems are often tuned by the rifle manufacturer for optimal performance of the firearm. However, the addition of an accessory (e.g., a suppressor) or the wear of components due to usage alters the firing characteristics of the firearm.

To compensate for such changes, adjustable gas regulators were introduced that allow for the metering (i.e., increasing or decreasing) of the gas flow. The majority of adjustable gas regulators use a screw or piston of some type to partially obstruct a round gas hole in the gas block and gas tube of the firearm/rifle, such as an AR-15. The flaw in this design is that as the screw is turned in and begins to obstruct the gas flow, it has little effect and that effect gets more progressive as the screw approaches the apex/center of the gas hole, and then progressively less as the screw advances into the back side of the hole. This causes inconsistent gas metering as one turn or one click has different effect from the previous adjustment and is unpredictable. Additionally, the gasses on some designs cause the screw to work its way out, and the tip of the screw may be eroded by the flow of hot gasses during operation, or, fouling of the threads of the screw with carbon from the burning gasses and gun powder residue.

SUMMARY

A device and system for the metering of gas into a gas driven reloading system of a rifle is provided. The device, in certain embodiments, is a gas plate that includes a plurality of openings of differing radii, and a plurality of positioning notches formed on an edge of the gas plate. The device also includes, in certain embodiments, a series of teeth formed on a surface of the gas plate, where the series of teeth are formed with a pitch configured to correspond with threads of a worm drive, and where at least a partial rotation of the worm drive slidingly positions the gas plate with respect to the adjustable gas regulator.

In certain embodiment, the worm drive further comprises an annular groove positioned adjacent a first end of the worm drive, and the threads of the worm drive are positioned adjacent a second end of the worm drive. In certain embodiments, the adjustable gas regulator includes a worm drive retention plate having a semi-circular ridge configured to engage the annular groove. The worm drive retention plate may be configured to be secured in an opening of the adjustable gas regulator.

In certain embodiments, the adjustable gas regulator comprises a bore extending longitudinally from a first end to a second end, and where the bore is configured to receive the worm drive. In certain embodiments, each of the plurality of positioning notches is formed with a semi-circular shape and configured to engage a positioning ball. The positioning ball may be biased by a spring plate coupled to an exterior surface of the adjustable regulator.

The system includes, in certain embodiments, the device and a body having an opening configured to receive a movable gas plate and a worm drive. A rifle is also provided that includes the adjustable gas regulator with a moveable gas plate as described above.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

The subject matter of the present application has been developed in response to the present state of the art, and in particular, in response to the problems and needs in the art that have not yet been fully solved by currently available gas regulators. Accordingly, the subject matter of the present application has been developed to provide a firearm suppressor that overcomes at least some shortcomings of the prior art.

As will be described in greater detail below, the gas regulator includes an adjustable worm drive that drives a small narrow plate that moves over a gas port in the barrel and contains a series of precise holes for exact and predictable metering. The current disclosure illustrates a gas plate with precise holes in sequence. So, if a rifle barrel has a 0.082 gas port, then the user would obtain a gas plate that has the first hole in the sequence at 0.082 and then following holes in smaller sizes, for example, either 0.001 or 0.002 smaller. In one embodiment, a gas plate may go from 0.082, 0.081, 0.080, 0.079, 0.078, and 0.077. Alternatively, the openings may be reduced by 0.002, or even a custom plate with specific sizes for different ammo or suppressed use, etc.

The movable gas plate is narrow and small, therefore there is a much smaller opening for any gas to escape. Also, the opening that receives the worm drive is arranged co-linearly with the barrel (i.e., extending along the same longitudinal axis as the barrel), so that any gasses that might escape are vented in the same direction as the bore and do not affect the shooter. Beneficially, the below described worm drive system can be accessed from the end of the rifle and therefore can be used with almost any handguard. There may be six or more, adjustable positions on the plate.

In another embodiment, the depicted gas regulator includes detents or notches to signal when a port on the plate is in alignment with the barrel's port. In one embodiment, the openings in the gas plate run from largest to smallest, and a user can count the number of clicks to know which opening is in alignment with the port of the barrel. In another embodiment, the block includes indicator notches that coordinate with the worm drive to indicate which port is in use. The worm drive can be driven by hand, by using a coin, a flat blade screwdriver, a hex wrench, ¼" nut driver, socket, etc.

The description of elements in each figure may refer to elements of proceeding figures. Like numbers refer to like elements in all figures, including alternate embodiments of like elements. Similar elements may be referred to with a number and a letter, such as "102a" and "102b", when identified individually, and when referred to jointly by the number only (i.e., "102" without that "a" or "b").

Figure 1:
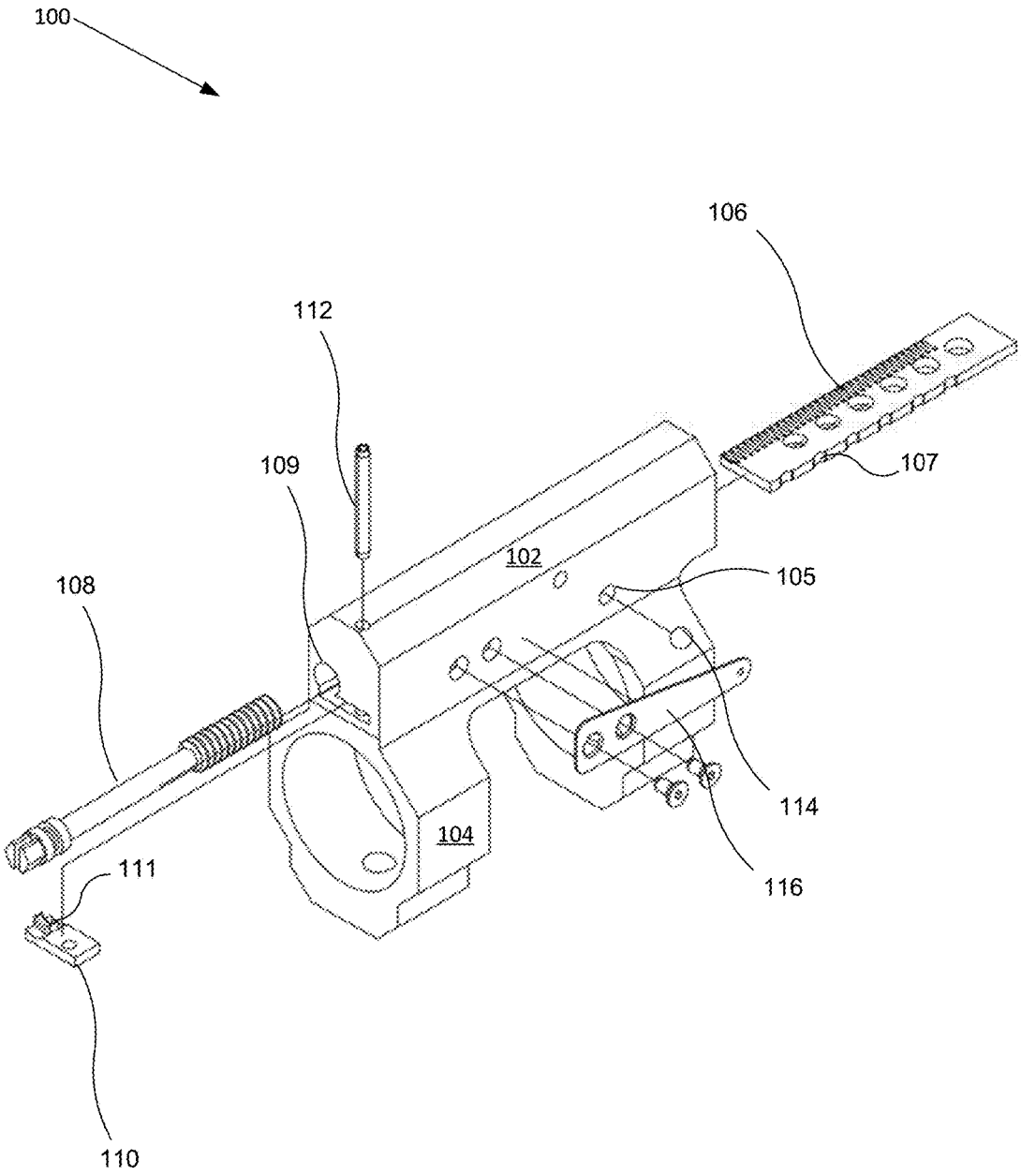
FIG. 1 is an exploded view diagram illustrating one embodiment of a worm drive gas regulator ("regulator") in accordance with embodiments of the present disclosure.

FIG. 1 is an exploded view diagram illustrating one embodiment of a worm drive gas regulator ("regulator") 100 in accordance with embodiments of the present disclosure. The regulator assembly 100, in one embodiment, includes a body 102 with barrel bores 104 that are configured to engage the barrel of a rifle. The barrel bores 104 are configured to slide over a barrel and be positioned such that the regulator 100 and gas plate 106 are positioned above a gas port (not shown) in a barrel. An upper portion of the body 102 is configured with an opening 109 to receive the adjustable gas plate 106, and a worm drive 108. The opening 109, in one embodiment, comprises a bore that extends longitudinally from one end of the regulator 100 to an opposing end of the regulator 100. In this embodiment, the worm drive 108 is insertable into one of the ends of the bore, and a gas tube (or other gas driven system) is insertable into the opposite end of the bore. A worm drive retention plate 110 is also provided, and may be secured with a pin 112.

The gas regulator 100 is also configured with an opening 105 for receiving a position indicator, which in one embodiment, may be a ball 114 that engages a series of detents 107 or notches in the gas plate 106. A spring plate 116 provides a biasing force to the ball 114 and maintains the ball 114 at least partially within the opening. The spring plate 116 may be rigidly mounted at one end to the regulator 100. The spring plate 116 may be formed of a thing sheet of metal that is capable of flexing enough to allow the ball 114 to move in to and out of position within the detents 107.

Figure 2A:
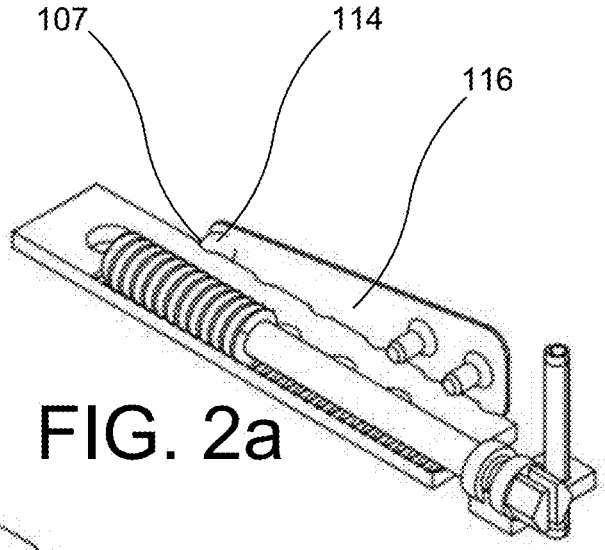
FIGS. 2*a* and 2*b* are perspective view diagrams illustrating embodiments of the gas plate and worm drive in accordance with embodiments of the present disclosure.
Figure 2B:
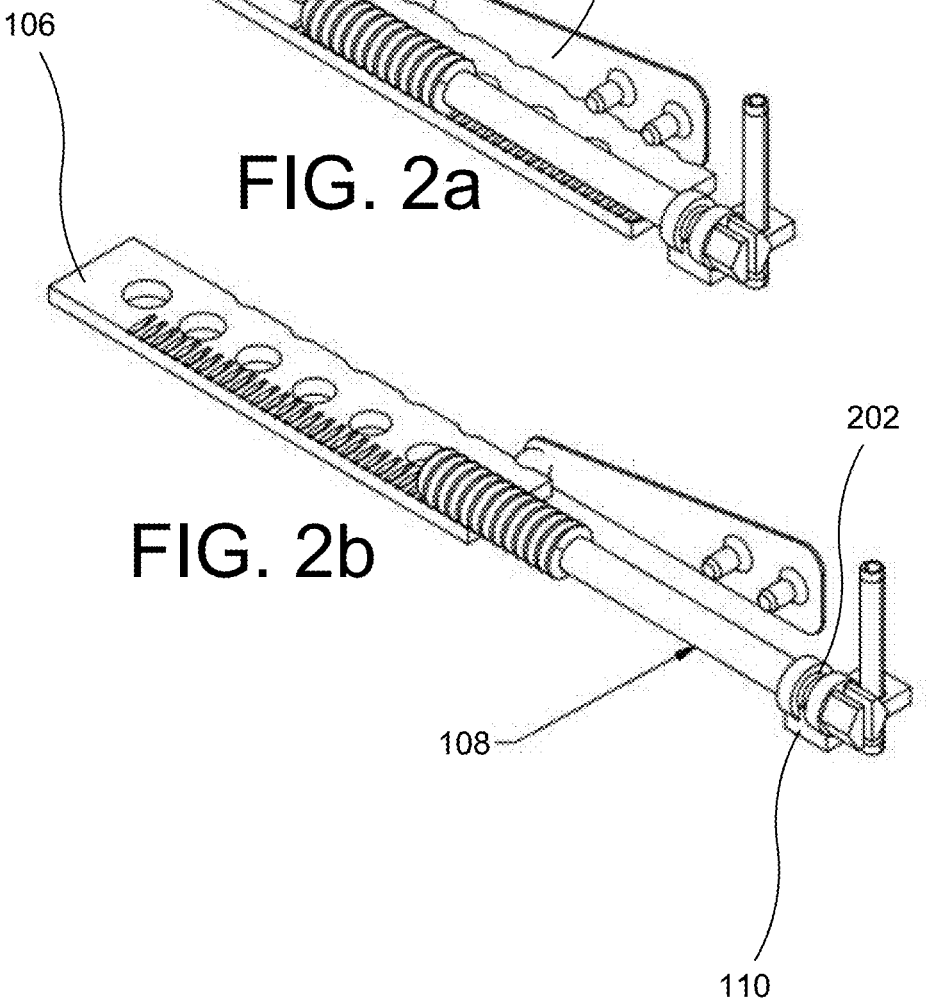

FIGS. 2*a* and 2*b* are perspective view diagrams illustrating embodiments of the gas plate 106 and worm drive 108 in accordance with embodiments of the present disclosure. In the depicted embodiments, the worm drive 108 rests on the worm-drive retention plate 110. The worm-drive retention plate 110, in one embodiment, includes a ridge 111 (see FIG. 1) that extends into an annular groove 202 formed on the shaft of the worm drive 108. The ridge maintains the position of the worm drive 108 with respect to the body 102. As the threads of the worm drive 108 shaft engage corresponding threads or grooves of the gas plate 106, the gas plate 106 either moves toward to the worm drive or away from the worm drive 108.

Also depicted is the engagement of the ball 114 to the notches or detents 107 formed in the side of the gas plate. The ball moving in to and out of engagement with the notches causes the ball retention plate 116 to move in and out. This visual indication allows a user to know the position of the gas plate 106 within the body 102. Stated differently, a user is able to identify that an opening in the gas plate is properly aligned with the gas port of the barrel. In another embodiment, an aural click may be heard, also indicative of the position.

Figure 3:
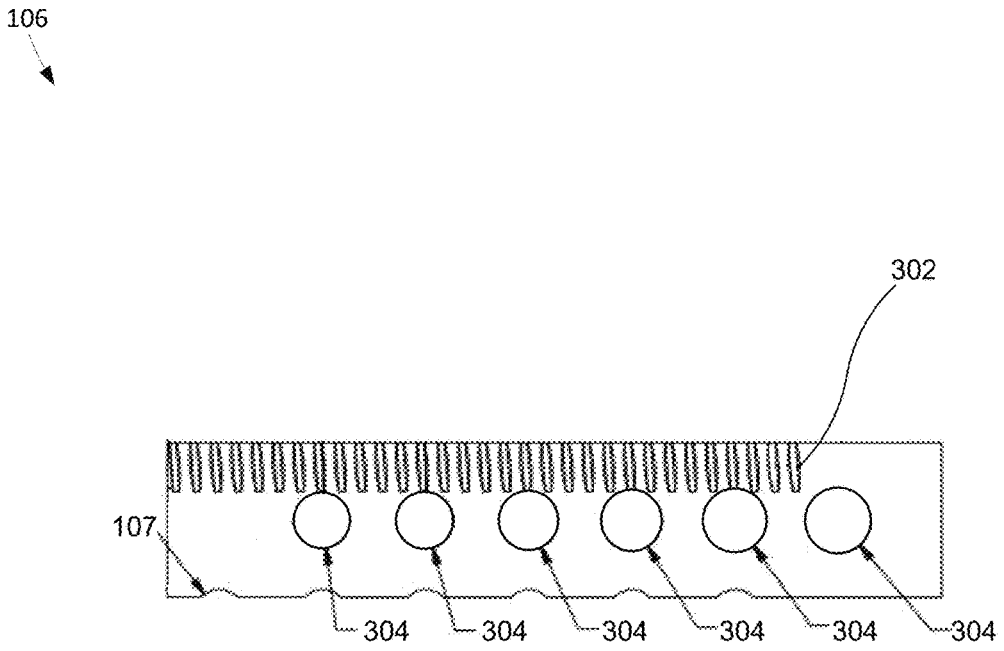
FIG. 3 is a schematic diagram illustrating one embodiment of the gas plate in accordance with embodiments of the present disclosure.

FIG. 3 is a schematic diagram illustrating one embodiment of the gas plate 106 in accordance with embodiments of the present disclosure. The gas plate 106, in one embodiment, includes grooves 302 formed in the gas plate 106 that correspond with a gear pitch and tooth profile of the worm drive. In one embodiment, the gear pitch and tooth profile may be altered to increase the movement of the gas plate with respect to the worm drive. Stated differently, faster or slower adjustments of the gas plate when the worm drive is turned may be implemented by providing different gear pitches and tooth profiles. In such an example, the pitch may be altered such that a quarter turn, for example, advances the gas plate enough to align an adjacent opening with the gas port. Accordingly, visual indicators on the body 102 may be positioned to correspond with the position of the gas block, as will be described below in greater detail with reference to FIG. 7.

The gas plate 106 also includes a series of openings 302 with varying radii, as depicted. The radii may be modified to suit a particular application. In one embodiment, the sizes of the openings sequentially increase or decrease, as described above. This beneficially aids in adjustment, as the user will know that the next opening will be either slightly larger or slightly smaller than the currently positioned opening. Notches may be formed in one edge of the gas plate to indicate a position. Counting the "clicks" or number of times the ball engages the notch allows the user to take note of the position of the gas plate. Alternatively, the visual indicator of FIG. 7 may indicate the position.

Figure 4:
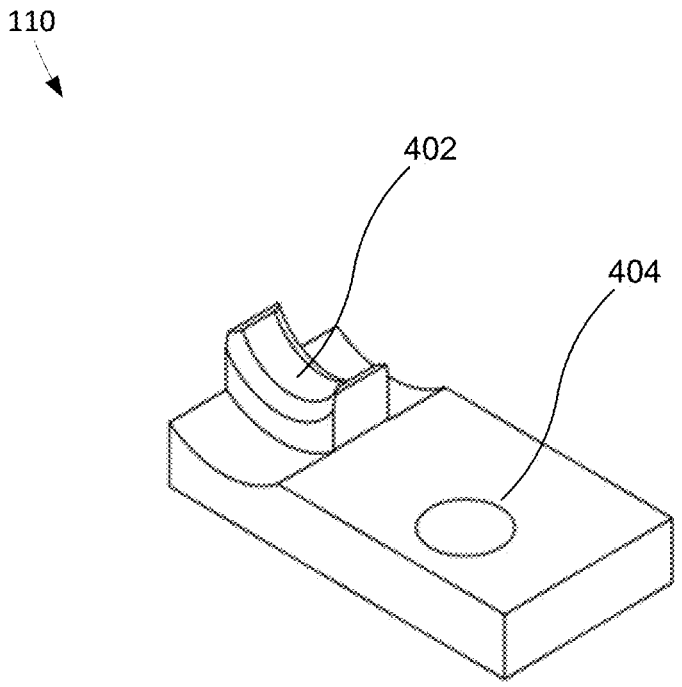
FIG. 4 is a perspective view diagram illustrating one embodiment of a worm drive retention plate in accordance with embodiments of the present disclosure.

FIG. 4 is a perspective view diagram illustrating one embodiment of a worm drive retention plate 110 in accordance with embodiments of the present disclosure. As described above, the worm drive retention plate 110, in one embodiment, includes a semi-circular ridge 402 configured to engage an annular groove or notch in the worm drive. The ridge allows for the rotation of the worm drive while maintaining the longitudinal position of the worm drive with respect to the regulator 100. Stated differently, the ridge fixes the position of the worm drive and cause a rotation of the worm drive to move the gas plate, instead of the other way around. An opening 404 may also be provided to allow the retention pin to secure the retention plate 110 within the body 102. This, consequently, locks the retention plate 110 and the worm drive within the body 102.

Figure 5:
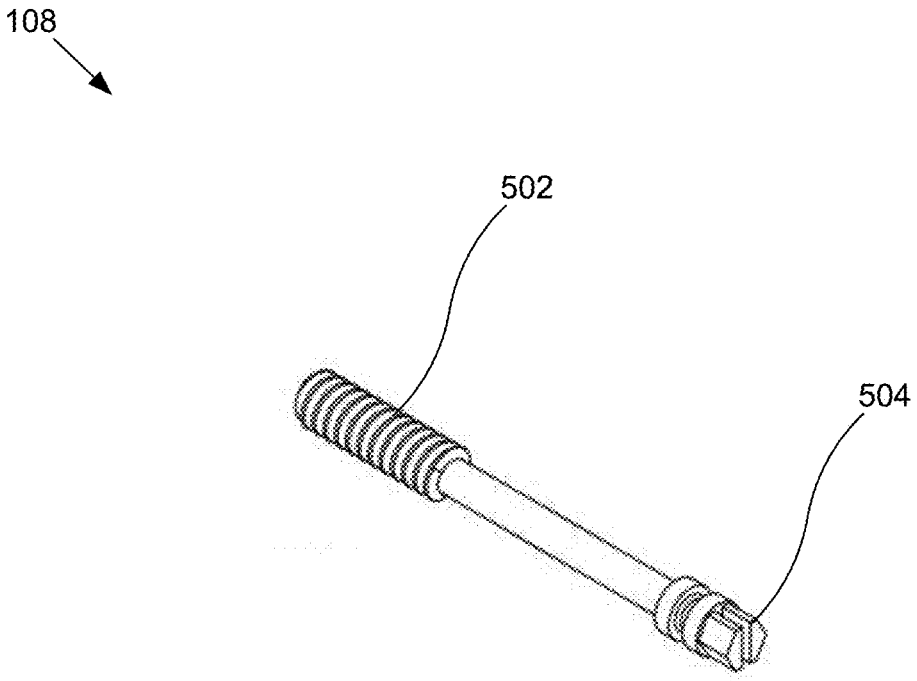
FIG. 5 is a perspective view diagram illustrating one embodiment of the worm drive in accordance with embodiments of the present disclosure.

FIG. 5 is a perspective view diagram illustrating one embodiment of the worm drive 108 in accordance with embodiments of the present disclosure. As discussed above, the worm drive 108 includes threads 502 positioned near a first end of the worm drive, and a turnable head 504 positioned at the second end of the worm drive. The threads 502 are configured to engage the teeth or grooves formed in the surface of the gas plate. Turning the worm drive 108 cause the gas plate to slide longitudinally with respect to the body 102. The turnable head 504, in one embodiment, has a hexagonal nut that may be turned with a socket or wrench. Additionally, a slot in the turnable head 504 allows the worm drive to be turned with a coin. Alternative turnable heads 504 are contemplated, including but not limited to, thumb screws, etc.

Figure 6:
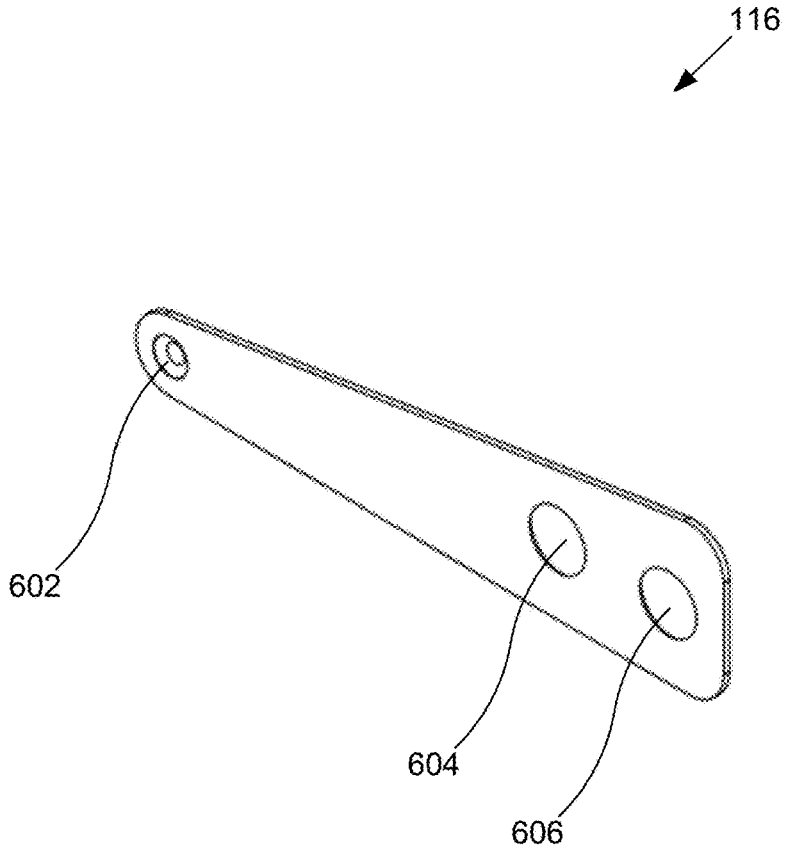
FIG. 6 is a perspective view diagram illustrating one embodiment of the ball retention plate in accordance with embodiments of the present invention.

FIG. 6 is a perspective view diagram illustrating one embodiment of the ball retention plate 116 in accordance with embodiments of the present invention. In the depicted embodiment, the ball retention plate 116 includes multiple openings. Some of these openings allow fasteners to secure the ball retention plate 116 to the body 102. The smaller opening is configured to engage the ball and maintain the ball within its opening in the body 102. The ball retention plate 116 is formed of a material that is capable of providing a biasing force to the ball, such as metal, or a composite of metal. The biasing force pushes the ball against the notches formed in the side of the gas plate. As the gas plate is moved, the ball pushes outward on the ball retention plate 116 until the ball engages the next notch. Because the ball retention plate 116 is always pushing on the ball, the ball makes an audible click as it engages the next notch and indicates to the user that the next opening has been aligned with the gas port.

Figure 7:
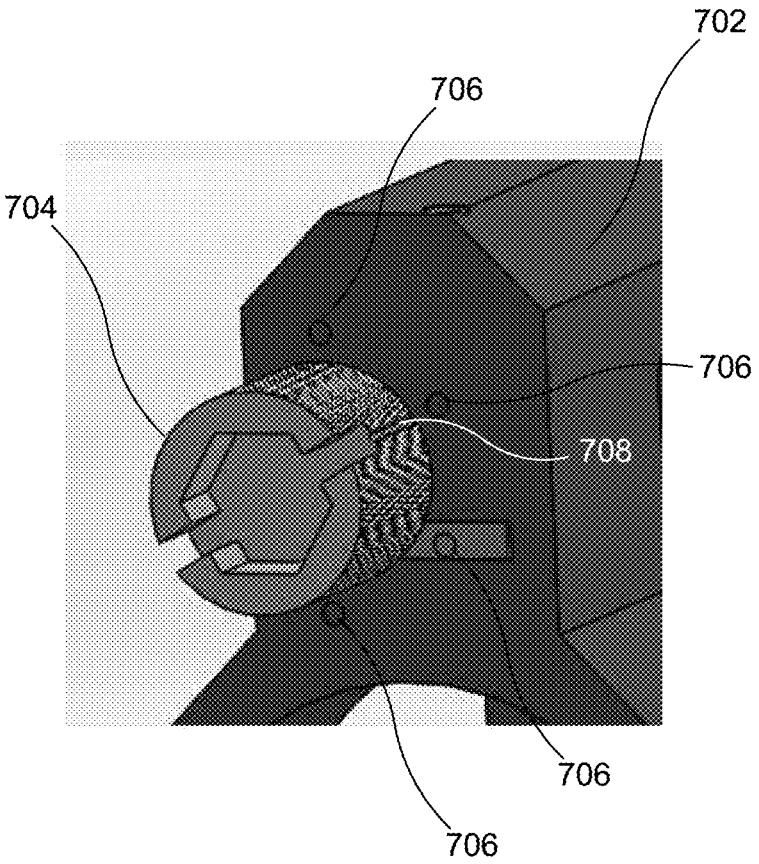
FIG. 7 is a perspective view diagram illustrating one embodiment of the body and the worm drive in accordance with embodiments of the present disclosure.

FIG. 7 is a perspective view diagram illustrating one embodiment of the body 702 and the worm drive 704 in accordance with embodiments of the present disclosure. The body 702, in one embodiment, may include visual indicators 706 formed in a surface of the body 702. The visual indicators 706, for example, are dots positioned on the body 702 so as to be radially adjacent an outer surface of the turnable head of the worm drive 704 when the worm drive 704 is inserted in the body 702. An indicator 708 formed in the outer surface of the turnable head is configured to indicate a position of the gas plate.

As described above, the pitch of the worm drive may be selected to advance the gas plate with a small turn of the turnable head. In the depicted embodiment, a sixth of a full rotation will advance the gas plate from one position to the adjacent position. Also depicted are the different mechanisms that may be used for turning the turnable head, such as a hex-shaped opening for receiving a hex drive, a slot for receiving a screwdriver, or a knurled outer surface for engaging a user's thumb and index finger.

Figure 8:
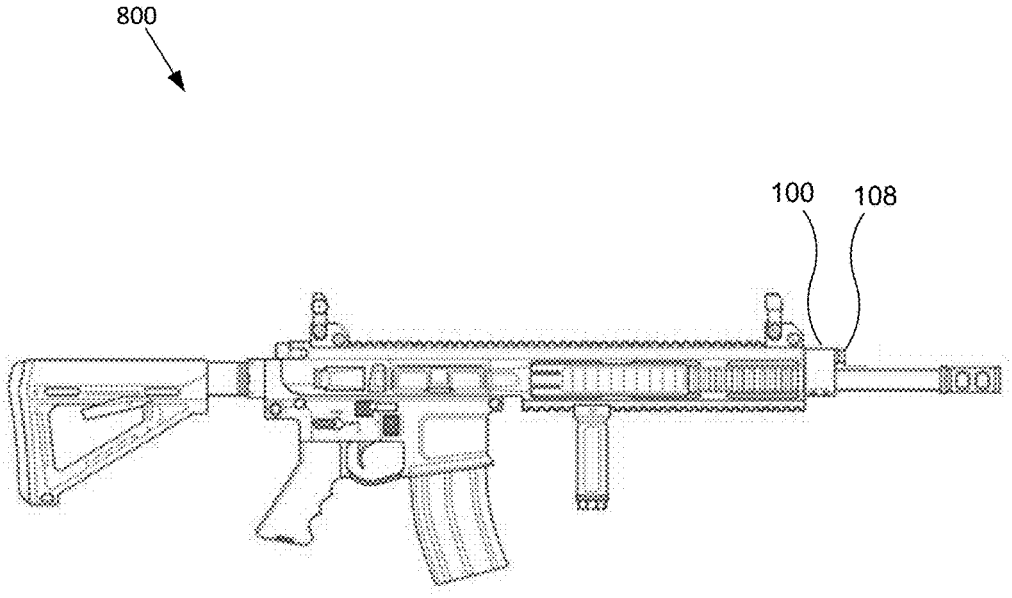
FIG. 8 is a side view diagram illustrating one embodiment of a rifle including an adjustable worm drive gas regulator in accordance with embodiments of the present disclosure.

FIG. 8 is a side view diagram illustrating one embodiment of a rifle 800 including an adjustable worm drive gas regulator 100 in accordance with embodiments of the present disclosure. As described above, the regulator 100 is configured to couple to the barrel of the rifle 800. The worm drive 108 is accessible from the barrel end of the rifle, beneficially, for ease of adjustment. The regulator 100 is configured to be mounted over the gas port of the barrel so as to align one of the openings of the gas plate with the gas port.

Figure 9:
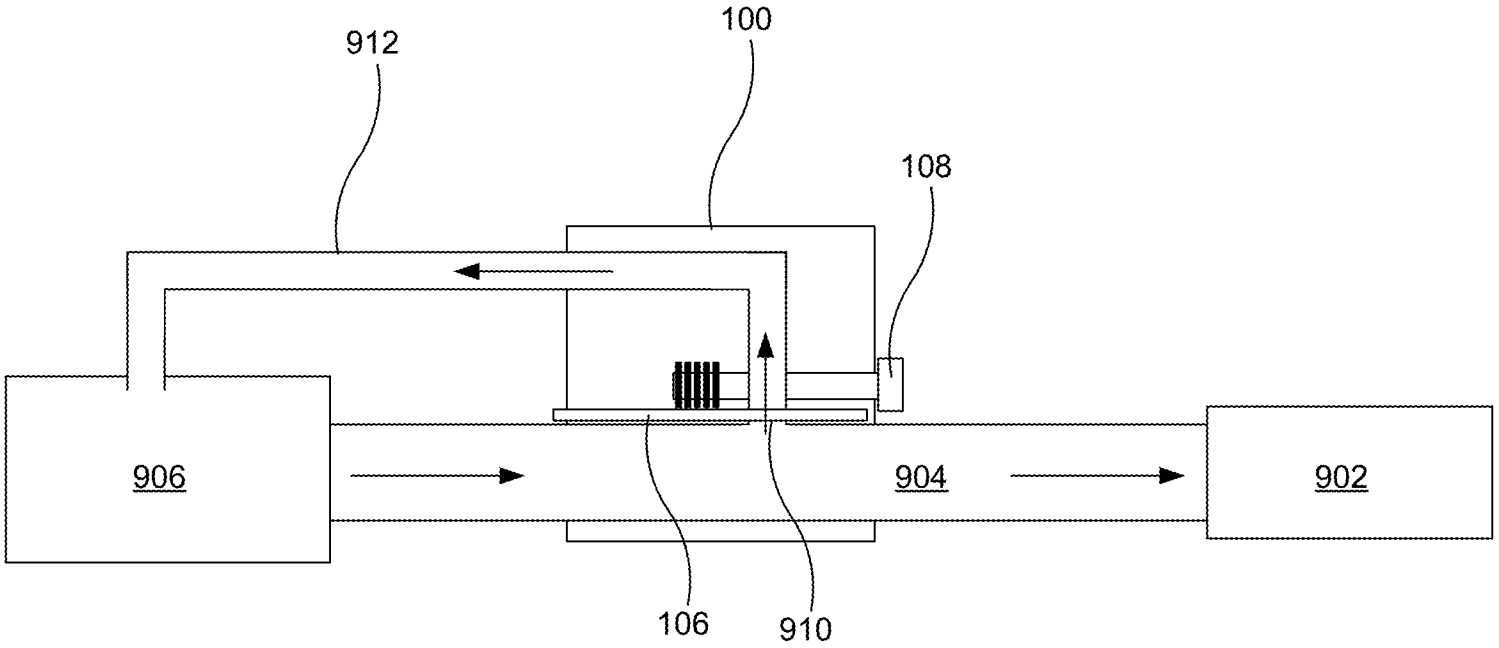
FIG. 9 is a schematic block diagram illustrating one embodiment of a gas-driven rifle in accordance with embodiments of the present disclosure.

FIG. 9 is a schematic block diagram illustrating one embodiment of a gas-driven rifle 900 in accordance with embodiments of the present disclosure. As known to those of skill in the art, semi-automatic and automatic rifles are often driven by the flow of gasses that result from the firing of a round of ammunition. After the initial round of ammunition is loaded, the gasses may drive the expulsion of the spent round and the loading of the next round. Examples of common gas-driven systems are gas-piston and gas-impingement.

If a silencer 902 is attached to the barrel 904, gas flow (indicated by the arrows) exiting the barrel may be inhibited causing back pressure that creates a greater or less than optimal pressure on the gas-driven system. Beneficially, the different diameter openings in the gas plate 106 can increase or decrease the gas pressure on the gas-driven system. A receiver 906 (graphically depicting an upper and lower receiver) houses all of the components necessary to fire a round of ammunition. The barrel 904 couples to the receiver 906, and the regulator 100 couples to the barrel to align with the gas port 910 of the rifle 900.

A gas tube 912 (or gas piston, depending upon the system utilized by the rifle) is fluidly coupled with the gas port 910. As a round of ammunition travels down the barrel 904, gasses are forced through the gas port 910 and in to the gas tube 912. The gasses travel through the gas tube 912 back to the receiver 906 and cause the rifle to eject the spent ammunition casing and load a new round, as is known to those of skill in the art. The worm drive 108, as is described above in greater detail, may be rotated to position the gas plate 106 such that one of the openings of the gas plate 106 aligns with the gas port 910 to meter the flow of gas through the gas tube 912. In one embodiment, a channel is formed in the interior of the regulator 100 to fluidly couple the gas port 910 with the gas tube 912.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gas plate for an adjustable gas regulator, the gas plate comprising:

a plurality of openings of differing radii;

a positioning ball biased by a spring plate, where the spring plate is coupled to an exterior surface of the adjustable gas regulator;

a plurality of positioning notches formed on an edge of the gas plate, where each of the plurality of positioning notches is formed with a semi-circular shape and configured to engage the positioning ball; and a series of teeth formed on a surface of the gas plate, where the series of teeth are formed with a pitch configured to correspond with threads of a worm drive, and where at least a partial rotation of the worm drive slidingly positions the gas plate with respect to the adjustable gas regulator.

2. The gas plate of claim 1, where the worm drive further comprises an annular groove positioned adjacent a first end of the worm drive.

3. The gas plate of claim 2, where the threads of the worm drive are positioned adjacent a second end of the worm drive.

4. The gas plate of claim 2, further comprising a worm drive retention plate having a semi-circular ridge configured to engage the annular groove.

5. The gas plate of claim 4, where the worm drive retention plate is configured to be secured in an opening of the adjustable gas regulator.

6. The gas plate of claim 1, where the adjustable gas regulator comprises a bore extending longitudinally from a first end to a second end, and where the bore is configured to receive the worm drive.

7. An adjustable gas regulator comprising:

a body having an opening configured to receive a movable gas plate and a worm drive;

where the gas plate comprises a plurality of openings of differing radii, a positioning ball biased by a spring plate, where the spring plate is coupled to an exterior surface of the adjustable gas regulator, a plurality of positioning notches formed on an edge of the gas plate, where each of the plurality of positioning notches is formed with a semi-circular shape and configured to engage the positioning ball, and a series of teeth formed on a surface adjacent the plurality of openings; and where the worm drive is configured to engage the series of teeth and adjust the position of the gas plate in response to at least a partial rotation of the worm drive.

8. The gas regulator of claim 7, where the worm drive further comprises an annular groove positioned adjacent a first end of the worm drive.

9. The adjustable gas regulator of claim 8, where the threads of the worm drive are positioned adjacent a second end of the worm drive.

10. The adjustable gas regulator of claim 8, further comprising a worm drive retention plate having a semi-circular ridge configured to engage the annular groove.

11. The adjustable gas regulator of claim 10, where the worm drive retention plate is configured to be secured in an opening of the adjustable gas regulator.

12. The adjustable gas regulator of claim 7, where the adjustable gas regulator comprises a bore extending longitudinally from a first end to a second end, and where the bore is configured to receive the worm drive.

13. A rifle with a gas driven reloading system, the rifle comprising:

an elongated barrel having a bore through which a round of ammunition passes, where the barrel includes a gas port that exhausts gas into the reloading system; and an adjustable gas regulator for metering the flow of the gas into the reloading system, the adjustable gas regulator comprising:

a body having an opening configured to receive a movable gas plate and a worm drive;

where the gas plate comprises a plurality of openings of differing radii, a positioning ball biased by a spring plate, where the spring plate is coupled to an exterior surface of the adjustable gas regulator, a plurality of positioning notches formed on an edge of the gas plate, where each of the plurality of positioning notches is formed with a semi-circular shape and configured to engage the positioning ball, and a series of teeth formed on a surface adjacent the plurality of openings; and where the worm drive is configured to engage the series of teeth and adjust the position of the gas plate in response to at least a partial rotation of the worm drive.

14. The rifle of claim 13, where the worm drive further comprises an annular groove positioned adjacent a first end of the worm drive.

15. The rifle of claim 14, where the threads of the worm drive are positioned adjacent a second end of the worm drive.

16. The rifle of claim 14, further comprising a worm drive retention plate having a semi-circular ridge configured to engage the annular groove.

* * * * *